United States Patent [19]

McDonough

[11] 4,189,691

[45] Feb. 19, 1980

[54] MICROWAVE TERMINATING STRUCTURE

[75] Inventor: Robert J. McDonough, Ventura, Calif.

[73] Assignee: Raytheon Company, Lexington, Mass.

[21] Appl. No.: 850,744

[22] Filed: Nov. 11, 1977

[51] Int. Cl.[2] ..... H01P 1/26

[52] U.S. Cl. ..... 333/22 R; 333/26; 333/238

[58] Field of Search ..... 333/22 R, 26, 81 A, 333/84 M, 238, 246; 338/216

[56] References Cited

U.S. PATENT DOCUMENTS 3,164,791 1/1965 Dent ..... 333/11

3,422,377 1/1969 Vient ..... 333/84 M UX

*Primary Examiner*—Paul L. Gensler

*Attorney, Agent, or Firm*—Richard M. Sharkansky; Joseph D. Pannone

[57] ABSTRACT

A microwave terminating structure is disclosed wherein a strip conductor formed on a dielectric support has one end adapted for coupling to a transmission line being terminated and a resistive load, disposed on the dielectric support, connected between the ends of the strip conductor. Disposed on one side of the dielectric support is a ground plane for the strip conductor. With such arrangement, the resistive load is disposed on the surface of the dielectric support enabling the substantially planar structure to be formed.

14 Claims, 8 Drawing Figures

MICROWAVE TERMINATING STRUCTURE

BACKGROUND OF THE INVENTION

This invention relates generally to microwave terminating structures and more particularly to microstrip and stripline terminating structures.

As is known in the art, microstrip or stripline transmission lines are unbalanced transmission lines because the electric field travels in a dielectric medium disposed between the printed strip circuitry and one or two ground planes. To terminate such transmission lines the load device is placed between the ground plane and the strip circuitry. This type of termination, however, requires the physical removal of a portion of the dielectric material in order to insert the load device so that it is attached between the strip conductor and the ground plane in order to dissipate the energy in the line being terminated. While such a termination has been found adequate in many applications, the requirement for removing the portion of the dielectric material for insertion of a load device is a relatively complex and expensive manufacturing process.

SUMMARY OF THE INVENTION

With this background of the invention in mind it is therefore an object of this invention to provide an improved, simpler, less complex microwave termination structure.

This and other objects of the invention are attained generally by providing a microwave transmission line terminating structure comprising: a dielectric structure; a strip conductor formed on one surface of such dielectric structure, such strip conductor having a first end adapted for coupling to a transmission line at a junction; a resistive load means for dissipating substantially all radio frequency energy having a predetermined wavelength, such load means having a first end electrically connected to the strip conductor at the junction and a second end electrically connected to a second end of the strip conductor; and a ground plane separated from the strip conductor by the dielectric structure. With such arrangement the load is disposed on the surface of the dielectric support structure thereby providing a planar termination for the transmission line.

In a preferred embodiment of the invention the length of the strip conductor is $n\lambda/2$ where n is an odd integer and the strip conductor is U-shaped so that the first and second ends are adjacent one another. Further, the strip conductor is made up of two quarter-wave sections, one transforming the impedance of the transmission line $Z_0$ to an impedance $Z_0\sqrt{5.83}$ at the junction of the two sections and the second transforming the impedance $Z_0$ at the second end to an impedance $Z_0/\sqrt{5.83}$ at the junction of the two sections, thereby creating a VSWR of 5.83 at such junction. In this way one-half of the power transmitted to the junction is reflected back from the junction and one-half of such power is passed along to the second section. Therefore, equal and opposite voltages are developed at the ends of the strip conductor and a load having an impedance $2Z_0$ dissipates substantially all of the power passed to the terminating structure.

BRIEF DESCRIPTION OF THE DRAWINGS

The foregoing features of this invention, as well as the invention itself, may be more fully understood from the following detailed description read together with the accompanying drawings, in which.

DESCRIPTION OF THE PREFERRED EMBODIMENT

Array Antenna

Figure 1:
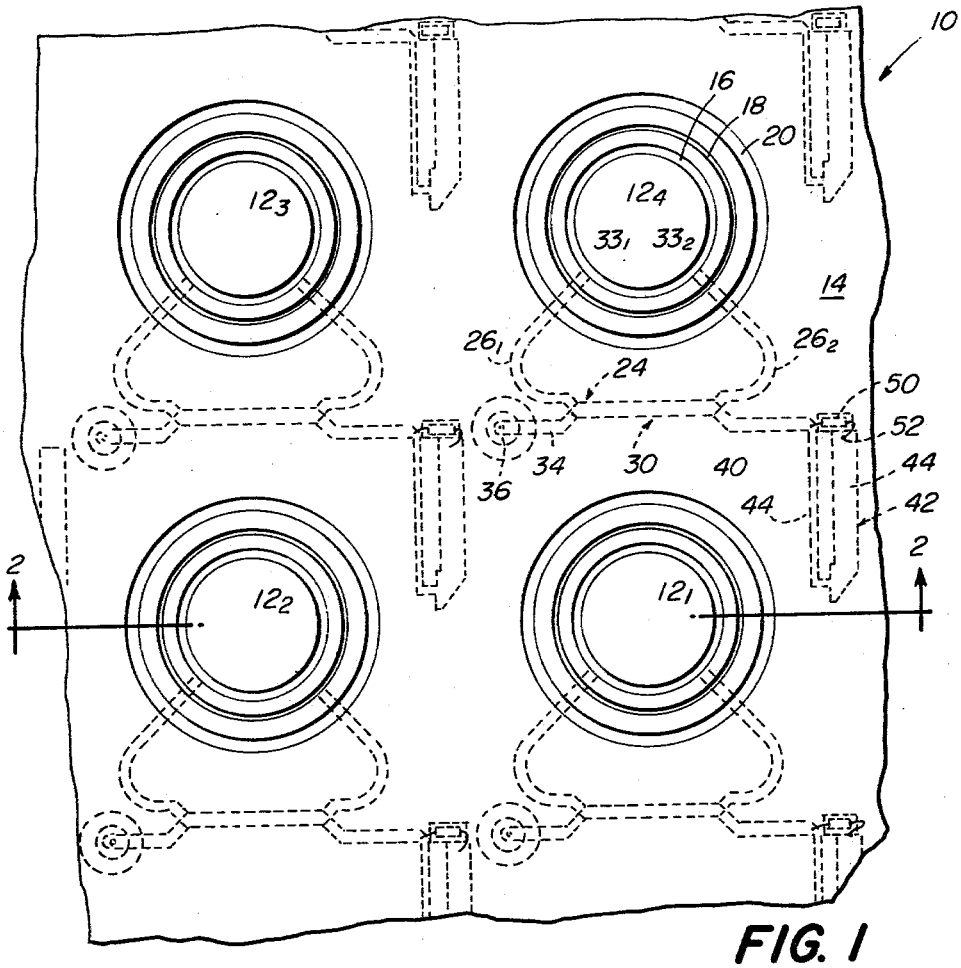
FIG. 1 is a plan view of a portion of an array antenna having a terminating structure according to the invention.
Figure 2:
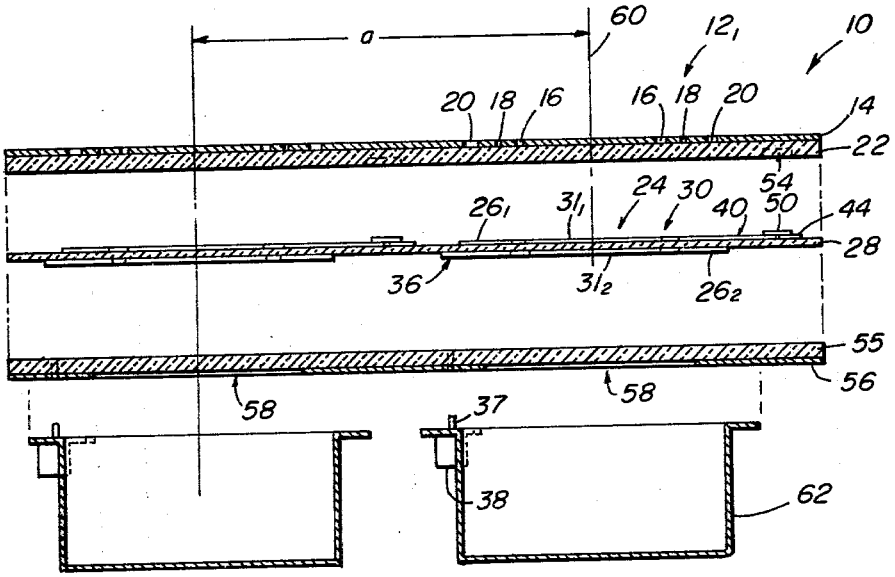
FIG. 2 is an exploded cross-sectional view of the array antenna taken along the line 2—2 shown in FIG. 1.
Figure 3:
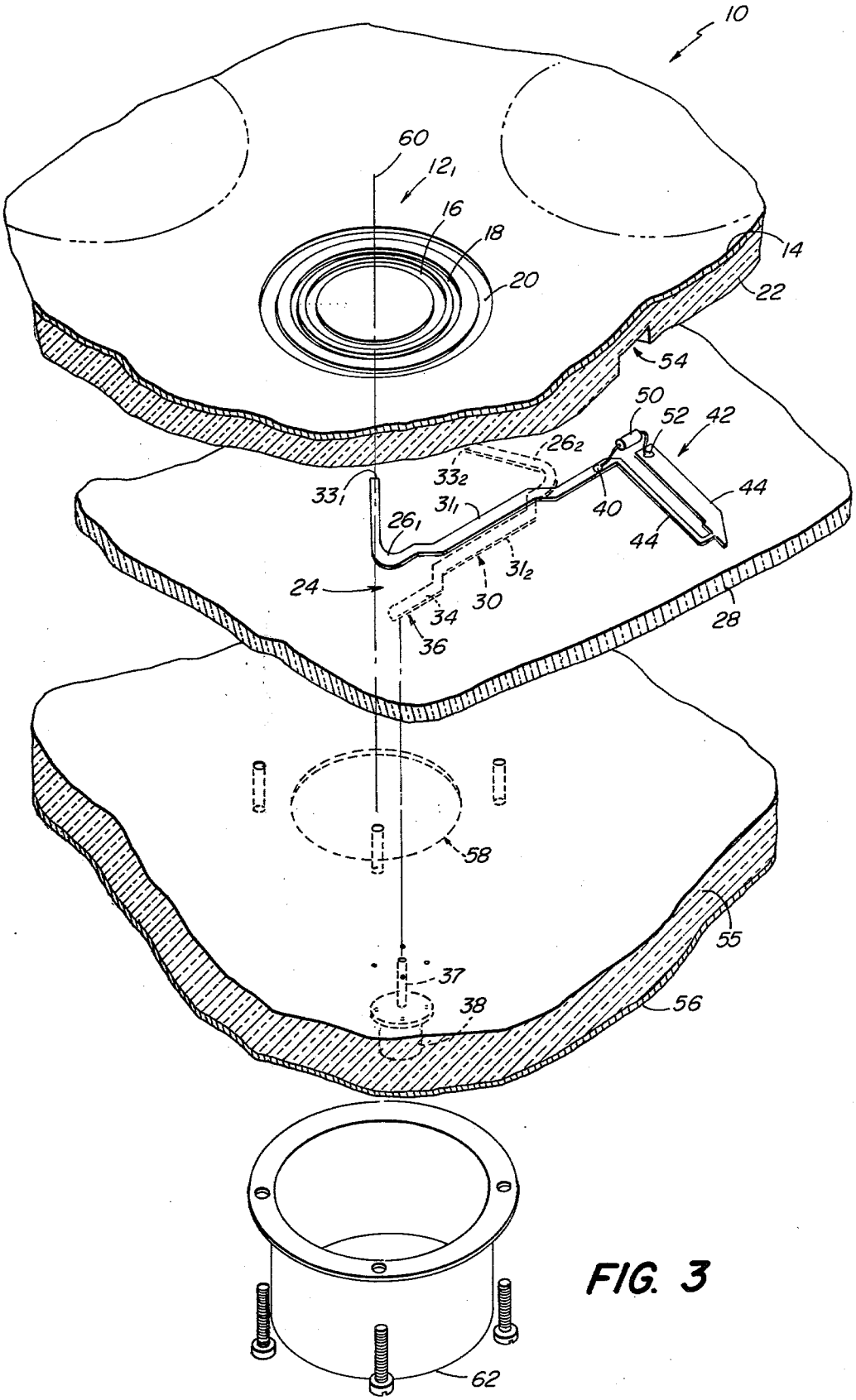
FIG. 3 is an exploded isometric view of a portion of the array antenna shown in FIG. 1.

Referring now to FIGS. 1, 2 and 3, an array antenna 10 is shown to include a plurality of, here thirty-six, antenna elements (only antenna elements $\mathbf{12}_1$–$\mathbf{12}_4$ being shown in FIG. 1) arranged in a rectangular $6\times6$ matrix. Such array antenna 10 is adapted to operate at a pair of frequencies $f_1$,$f_2$, here in the order of 1.5 GHz and 1.2 GHz, respectively, and produce a radiation pattern which has its maximum gain along an axis normal to the face of the array (i.e. the boresight axis). The maximum scan angle, i.e. the deviation of the beam from the boresight axis, is here 80°. Each one of the antenna elements is identical in construction. An exemplary one thereof, here antenna element $\mathbf{12}_1$, is shown in detail to include an electrically conductive sheet 14, here copper, having formed therein, using conventional photolithographic processes, three concentric circular apertues, or slots, 16, 18, 20. The inner diameter of the inner slot 16 is here 1.36 inches and the outer diameter of such inner slot 16 is here 1.56 inches. The inner diameter of the middle slot 18 is here 1.84 inches and the outer diameter of such middle slot 18 is here 1.95 inches. The inner diameter of the outer slot 20 is here 2.32 inches and the outer diameter of such outer slot 20 is here 2.66 inches. The center-to-center spacing between adjacent antenna elements, i.e. the exemplary length a (FIG. 2), is here 3.2 inches. The conductive sheet 14 is formed on a dielectric substrate 22, here a sheet of Teflon-Fiberglass material having a dielectric constant of 2.55 and a thickness of 1/16 inch.

Each one of the antenna elements includes a single feed structure 24 for enabling such element to radiate circularly polarized waves. In particular, such feed is made of copper and includes a pair of feed lines $\mathbf{26}_1$, $\mathbf{26}_2$, each of which extends along a radius of the slots 16, 18, 20. Such feed lines $\mathbf{26}_1$, $\mathbf{26}_2$ are disposed in 90° spatial relationship as indicated to enable the antenna to operate with circular polarization. One of such pair of feed lines, here feed line $\mathbf{26}_1$, is formed on the top side of a Mylar sheet 28 (here such sheet 28 having a thickness of 0.006 inches) and the other one of such feed lines, here feed line $26_2$, is formed on the bottom side of such sheet 28. The feed structure 24 is formed using conventional photolithographic processes. The feed lines $26_1$, $26_2$ are coupled to a conventional 90° hybrid coupler 30. The portions $31_1$, $31_2$ of feed lines $26_1$, $26_2$ overlap one another in the central region of the hybrid coupler 30 as shown (FIGS. 2, 3). The ends $33_1$, $33_2$ of the feed lines $26_1$, $26_2$ are spaced from the center of the antenna element $12_1$ a length, here 0.775 inches. The 90° hybrid coupler 30 has one port 34 connected to the center conductor 37 of a conventional coaxial connector 38 (here by solder) and a second port 40 connected to a terminating structure 42, the details of which will be described hereinafter. Suffice it to say here that such terminating structure provides an impedance matching structure for the hybrid coupler 30 and includes a strip conductor 44 (here copper) formed on the sheet 28 by conventional photolithography at the same time the feed line $26_1$ is being formed on such sheet 28 and a resistive load 50, here a carbon resistor, coupled between port 40 and a second end 52 of the strip conductor 44. The resistive load 50 is here adapted to dissipate substantially all of the radio frequency energy fed to the terminating structure 42.

A recess 54 is formed, here using conventional machining, in the dielectric substrate 22, for the resistive load 50, thereby enabling the dielectric substrate 22 and the sheet 28 to form a smooth, planar, compact structure when assembled one to the other in any conventional manner, here by affixing the sheet and substrate with a suitable nonconductive epoxy (not shown) about the peripheral portions of the entire array.

A second dielectric substrate 55, here also Teflon-Fiberglass material, having a dielectric constant of 2.55 and a thickness of 1/16 inch is provided and is suitably affixed to the sheet 28 to form a sandwich structure when assembled. The dielectric sheet 55 has an electrical conductive sheet 56, here copper, formed on the bottom side thereof, as shown. Such conductive sheet 56 has circular apertures 58 formed therein using conventional photolithography. Each one of the apertures 58 is associated with a corresponding one of the antenna elements, as shown. The apertures 58 have a diameter of here 2.195 inches and the centers of such apertures are along axes which pass through the centers of the antenna elements associated therewith. For example, for exemplary antenna elements $12_1$ the axis is represented by dotted line 60 in FIGS. 2 and 3.

Also associated with each one of the antenna elements is a cavity formed by a circular, cup-shaped element 62, here formed from aluminum. Such element 62 has a mounting flange for electrically and mechanically connecting such element to conductive sheet 56, such element 62 being disposed symmetrically about the circular aperture 58, as shown. Each cup-shaped element has a diameter of here 2.85 inches, a height of here 1.0 inches and a center which is aligned with the axis represented by dotted line 60 (i.e. the center of the associated antenna element). The conductive sheet 56 and the cup-shaped element 62 associated therewith form, inter alia, a ground plane for the associated antenna element. The outer conductor of the coaxial connector 58 used to feed such element is electrically and mechanically connected to the ground plane, in particular to the conductive sheet 56.

When assembled, the array antenna 10 provides a compact flush-mountable array antenna adapted to operate at 1.2 and 1.5 GHz. It is noted that the spacing between antenna elements "a" is less than $(1-1/N)\lambda_H/(1+\sin\theta)$ where N is the number of antenna elements along a scan axis of the array antenna (here N=6), $\theta$ is the maximum angular deviation of the beam from the foresight axis of the array (here $\theta=80°$) and $\lambda_H$ is the wavelength of the highest operating frequency of the antenna, here 1.5 GHz ($\lambda_H=7.86$ inches), that is "a"=3.2 inches and is less than 3.3 inches, thereby enabling the array antenna 10 to have satisfactory grating lobe characteristics. Further, it has been determined that the middle slot 18 enables the outer slot 20 to radiate radio frequency energy having a frequency 1.2 GHz, such energy having a wavelength $\lambda_L=9.8$ inches, which is greater than the circumference of such outer slot 20. That is, the largest slot, outer slot 20, radiates energy having a wavelength greater than the circumference of such outer slot 20. Likewise, the inner slot 16 enables the middle slot 18 to radiate radio frequency energy having a frequency 1.5 GHz, such energy having a wavelength $\lambda_H=7.86$ inches which is greater than the circumference of such middle slot 18. That is, the middle slot 18 radiates energy having a wavelength greater than the circumference of such middle slot 18.

Figure 4:
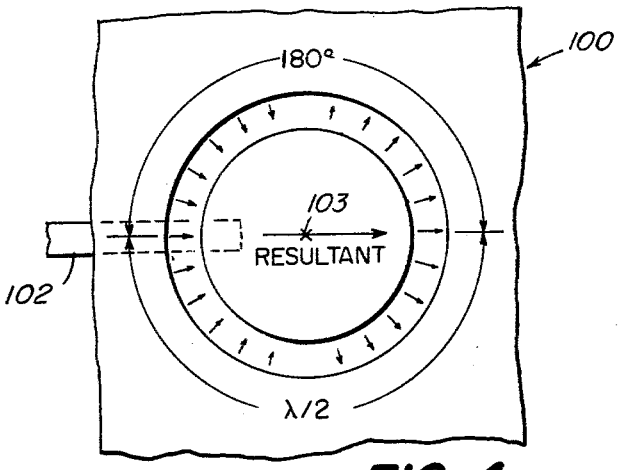
FIG. 4 is a drawing showing the electric field vector distribution developed within a single slotted antenna element excited by a single feed element.

One way to possibly understand the effect of the middle slot 18 on the operation of the outer slot 20 or, likewise, the effect of the inner slot 16 on the operation of the middle slot 18 is as follows: Referring to FIG. 4, a conventional slot antenna element 100 of the type described in U.S. Pat. No. 3,665,480, it is noted that the electric field distribution varies as shown by the arrows when such slot is fed by the feed line as indicated. It is apparent that, if the circumference of the slot is the operating wavelength the electric field component varies cosinusoidally with position around the slot. Therefore, considering, for example, a point 180° from the feedline 102, it is noted that because such point is electrically $\lambda/2$ in length from the feed line the phase of such field rotates 180° while the vector is also spatially rotated 180°. Therefore, the electric field vectors at the feedline 102 and at the point 180° from such feed line are aligned, as shown. Likewise, considering all electric field components it follows that a resultant field vector is produced, when the circumference of the slot is $\lambda$, which is normal to the boresight axis of the antenna, thereby producing a beam of radiation having its maximum gain along such boresight axis 103.

Figure 5:
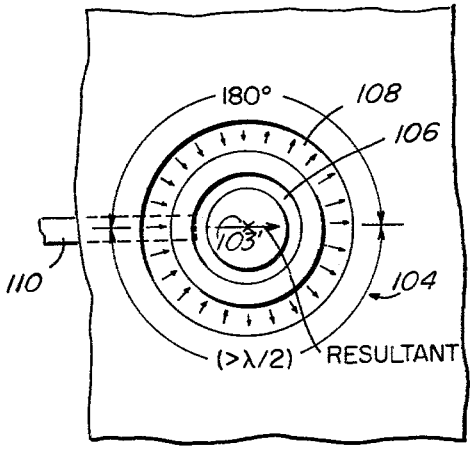
FIG. 5 is a drawing showing the electric field vector distribution developed within a dual annular slotted antenna element excited by a single element.

Referring now to FIG. 5, a two slot element 104 is shown. Because of the inner slot 106 the outer slot 108 radiates radio frequency energy having a wavelength greater than the circumference of the outer slot 108, i.e., in the order of 30% greater. As presently understood, it is felt that the inner slot 106 provides additional electrical phase retardation to the electric field vector as it propagates from the feed line 110 about the slot so that, for example, at a point 180° from such feed line 110 the phase of such field has rotated electrically 180°. Therefore, as indicated in FIG. 5, the resultant electric field vector is normal to the boresight axis 103' and the array antenna produces a beam of radiation having its maximum gain along the boresight axis of the array (i.e., normal to the face of the array).

Terminating Structure

Figure 6:
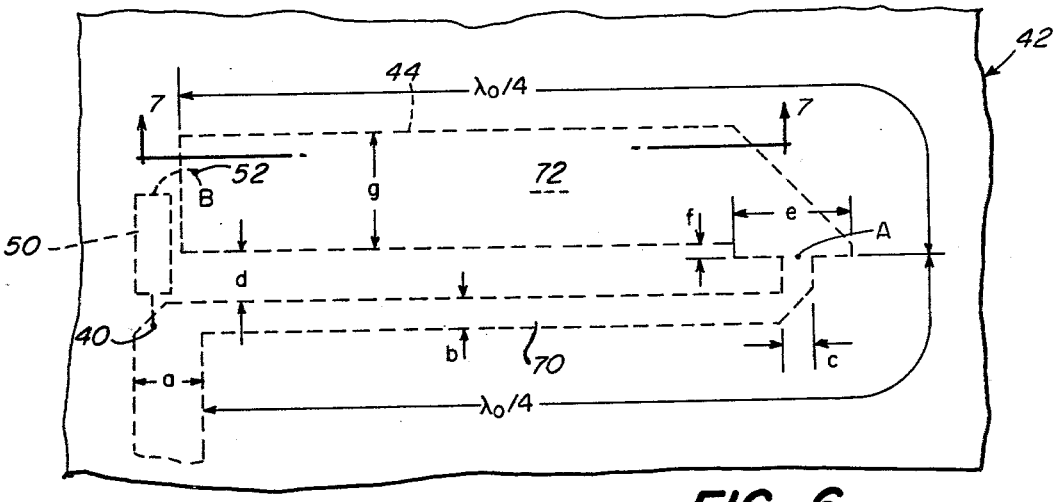
FIG. 6 is a plan view of a terminating structure according to the invention used with the antenna of FIG. 1.
Figure 7:
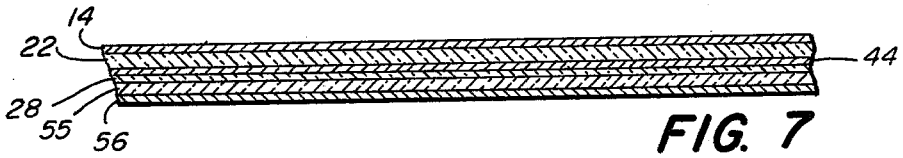
FIG. 7 is a cross-sectional view of a portion of the terminating structure shown in FIG. 6, such cross section being taken along the line 7—7 shown in FIG. 6.

Referring now to FIGS. 6 and 7, the terminating structure 42 is shown. Such terminating structure 42 is here a stripline terminating structure adapted to provide a loading circuit for the stripline feed network 24 (FIGS. 1, 2 and 3). As discussed briefly above, such structure 42 includes a strip conductor 44 formed on one surface, here the upper surface, of Mylar sheet 28, such sheet 28 being sandwiched between a pair of dielectric substrates 22, 55 as shown. The conductive sheets 14, 56 formed on such substrates 22, 55, respectively, provide ground planes for the feed line $26_1$ of feed network 24 and the strip conductor 44. The strip conductor 44 is integrally formed with the upper portion of hybrid junction 30, as discussed above, and, therefore, one end of feed line $26_1$ and one end of strip conductor 44 are connected to form a first junction 40. A resistive load 50, here a conventional carbon resistor, is deposited on the upper surface of Mylar sheet 28 as shown in FIGS. 2 and 3. Such resistive load 50 has one electrode electrically connected to the first junction 40 and a second electrode electrically connected to a second end 52 of the strip conductor 44. Such connections are here made by soldering the electrodes of resistive load 50 to the copper strip conductors forming junction 40 and the second end 52 of strip conductor 44. As will be discussed, the resistive load 50 is provided to absorb, or dissipate, substantially all of the radio frequency energy which passes to the terminating structure 42 from the feed network 24. That is, as will be discussed, the terminating structure 42 is designed so that the Voltage Standing Wave Ratio (VSWR) at the input to such structure 42, i.e., at junction 40, is 1.0 for energy having a wavelength $\lambda_o=(\lambda_H+\lambda_L)/2$. It is noted that $\lambda_o$ is the normal operating wavelength of the array antenna 10 (FIG. 1). Here the strip conductor 44 extends from the junction 40 to end 52 and has an electrical length $\lambda_o/2$.

Figure 8:
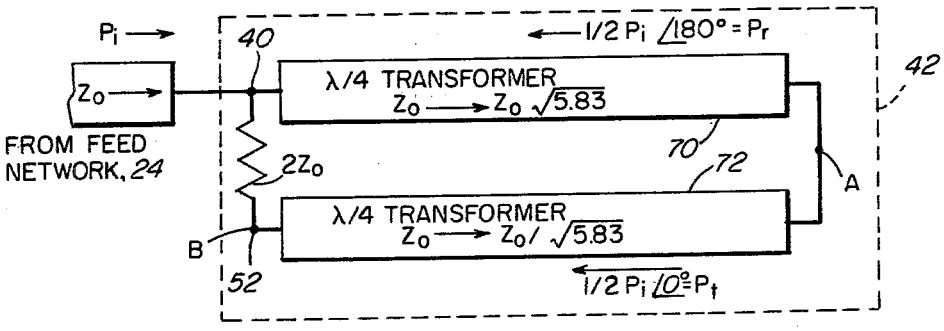
FIG. 8 is a schematic diagram of the terminating structure shown in FIGS. 6 and 7.

The terminating structure 42 includes two quarter-wave ($\lambda/4$) transmission line sections 70, 72. Transmission line section 70 extends from junction 40 to point A (FIG. 6), and transmission line section 72 extends from point A to end 52. The first $\lambda/4$ transmission line section 70 serves as an impedance transformer to transform the impedance of the strip feed network 24 feeding the terminating structure 42 (i.e., a microstrip transmission line formed by the feed line $26_1$ and its pair of ground planes), here $Z_0=50$ ohms, to an impedance at point A which causes an impedance mismatch at point A of 5.83:1. That is, referring also to FIG. 8, the first $\lambda/4$ transmission line section 70 transforms the impedance $Z_0$ at the input to such section 70 to an impedance $Z_0\times\sqrt{5.83}$ at point A. Therefore, because the first transmission line section 70 is a $\lambda/4$ impedance transformer, in order to match the input impedance of the line of the terminating impedance of such line, the impedance of such line must equal $\sqrt{(Z_0)(Z_0\sqrt{5.83})}$. Next, because at point A $$P_R/P_i=\{VSWR-1/VSWR+1\}^2$$

where $P_R$ is the reflected power at point A and $P_i$ is the incident power at point A, for $P_R=\frac{1}{2}P_i$ at point A, $$VSWR=5.83.$$

Since the transmitted power $P_t$ is equal to the incident power $P_i$ minus the reflected power $P_r$, $P_t=\frac{1}{2}P_i=P_r$.

Therefore, in order to obtain such a VSWR of 5.83 at point A and also in order for the impedance of the second transmission line section 72 to be $Z_0$ at point B, the second transmission line section 72 is designed to transform the impedance $Z_0$ at point B to an impedance $Z_0/\sqrt{5.83}$ at point A. It follows then that, for impedance matching, the impedance of the second transmission line section 72 becomes $\sqrt{(Z_0)(Z_0)/\sqrt{5.83}}=Z_0/\sqrt[4]{5.83}$. At the nominal operating wavelength, $\lambda_o$, $Z_1$ (which is the impedance of line 70 at point A) is equal to $Z_0\sqrt{5.83}$ and $Z_2$ (which is the impedance of line 72 at point A) is equal to $Z_0/\sqrt{5.83}$. Both impedances are "real" because of the quarter-wave transformers. It follows that the sign of the reflection coefficent is negative since $p=(Z_2-Z_1)/(Z_2+Z_1)=-0.707$. It is also noted that since $Z_1$ and $Z_2$ are positive and real the sign of the transmission coefficient, T, ($T=2\,Z_2/Z_1+Z_2$) is positive. This difference in sign between $\rho$ and T indicates a 180° phase difference between the reflected and incident voltages ($V_r$, $V_i$) at point A since $V_r=\rho V_i$ and $V_t=TV_i$. This phase relationship is preserved at points 40, 52 since the reflected and transmitted waves travel in identical media. Also, the impedance of points 40 and 52 are equal as discussed. Consequently, equal and opposite voltages are produced at points 40 and 52.

It is noted that the terminating structure 42 may be considered as a balun (balancing unit) which is terminated in a resistive load. That is, the terminating structure 42 may be considered as a microwave circuit which changes the stripline feed network 24 from an unbalanced line to a balanced line between junction 40 and end 52. This is accomplished by establishing VSWR of 5.83 at point A so that one-half of the incident power is reflected back along one of two parallel paths while transmitting the remaining one-half of the power along the second path so that the voltages at junction 40 and end 52 are equal in magnitude and opposite in phase (i.e., 180° out-of-phase) because the reflection at point A is brought about by a resistive mismatch which produces a 180° phase difference between $V_i$ and $V_t$ as discussed.

Therefore, the load 50 carries a current developed because of the voltage difference produced between port 40 and end 52 and, hence, such load dissipates the power associated with such current. The resistive load 50 here has an impedance $2Z_0=100$ ohms.

The dimensions of the strip circuitry shown in FIG. 6 are here:

a: 0.085 inches
b: 0.034 inches
c: 0.034 inches
d: 0.06 inches
e: 0.160 inches
f: 0.02 inches
g: 0.160 inches Having described a preferred embodiment of this invention, it is evident that other embodiments incorporating its concepts may be used. It is felt, therefore, that this invention should not be restricted to such preferred embodiment but rather should be limited only by the spirit and scope of the appended claims.

What is claimed is:

1. A microwave transmission line terminating structure comprising:

(a) a dielectric structure;

(b) a strip conductor defining a constrained electrical path between a first end thereof and a second end thereof, such strip conductor being supported on a first surface of such dielectric structure, such strip conductor having a single input port at the first end adapted for coupling to a transmission line;

(c) a resistive load means for dissipating substantially all radio frequency energy having a predetermined frequency which passes from the transmission line to the single input port of the terminating structure, such load means having a first end electrically connected to second end electrically connected to the second end of the strip conductor, such strip conductor and resistive load means being arranged to enable substantially all of the radio frequency energy passing from the transmission line to the terminating structure to pass solely to the strip conductor and the resistive load means; and (d) a ground plane supported on a second surface of such dielectric structure.

2. The structure recited in claim 1 wherein the input inpedance of such structure is equal to the characteristic impedance of the transmission line at a predetermined frequency.

3. The structure recited in claim 1 wherein the strip conductor has an electrical length of $n\lambda/2$ between the first and second ends thereof, where n is an odd integer and $\lambda$ is the nominal operating wavelength of the transmission line.

4. The structure recited in claim 3 wherein the resistive load means is disposed over the surface of the dielectric structure.

5. The structure recited in claim 4 wherein the strip conductor is substantially U-shaped.

6. The structure recited in claim 4 wherein the first and second ends of the strip conductor are adjacent one another.

7. The structure recited in claim 6 wherein the first and second ends of the strip conductor are separated by substantially the length of the resistive load means.

8. The structure recited in claim 3 wherein the strip conductor comprises a pair of equal length transmission sections, one section terminating solely into the other one of such sections.

9. The structure recited in claim 8 wherein each section is $n\lambda/4$ in length where n is an odd integer.

10. The structure recited in claim 9 where the transmission sections have different impedances.

11. A transmission line terminating structure comprising:

(a) a dielectric structure;

(b) a strip conductor having an electrical length $n\lambda/2$ where n is an odd integer supported on a first surface of such dielectric support structure, a first end of such strip conductor providing an input port adapted for coupling to a transmission line;

(c) a resistive load means for dissipating substantially all radio frequency energy having a predetermined frequency passing from the transmission line to the input port, such load means having a first end electrically connected to the input port and a second end electrically connected to a second end of the strip conductor, such strip conductor and resistive load means being arranged to enable substantially all the radio frequency energy passing to the terminating structure to pass solely through the strip conductor and the resistive load means; and (d) a ground plane supported on a second surface of the dielectric structure.

12. A transmission line terminating structure comprising:

(a) a pair of microwave transmission line sections having different impedances, each one of such sections having: a dielectric structure; a strip conductor supported on a first surface of such dielectric structure; and a ground plane supported on a second surface of such structure, and wherein the strip conductor of the first one of such sections has a first end adapted for coupling to a strip conductor of a transmission line and a second end connected to a first end of the strip conductor of the second one of the sections; and (b) a resistive load means electrically connected between the first end of the strip conductor of the first one of the sections and a second end of the strip conductor of the second one of the sections, or dissipating substantially all radio frequency energy having a predetermined frequency passing from the transmission line to the terminating structure, such strip conductor and resistive load means being arranged to enable substantially all the radio frequency energy passing from the transmission line to the terminating structure to pass solely to the strip conductor and the resistive load means.

13. The structure recited in claim 12 wherein each one of the pair of transmission line sections has an electrical length $n\lambda/4$ where n is an odd integer.

14. The structure recited in claim 13 wherein the impedance of the first section is $Z_0\sqrt{5.83}$ and the impedance of the second section is $Z_0/\sqrt{5.83}$ where $Z_0$ is the impedance of the transmission line being terminated.

* * * * *